US005455486A

United States Patent [19]

Tobler

[11] Patent Number: 5,455,486

[45] Date of Patent: Oct. 3, 1995

[54] METHOD AND CIRCUITRY FOR IGNITING FLUORESCENT LAMPS AT A PREDETERMINED TEMPERATURE OF THEIR CATHODES

[75] Inventor: Felix Tobler, Schanis, Switzerland

[73] Assignee: Knobel AG Lichttechnische Komponenten, Ennenda, Switzerland

[21] Appl. No.: 141,524

[22] Filed: Oct. 27, 1993

[30] Foreign Application Priority Data

Oct. 28, 1992 [EP] European Pat. Off. ..... 92118404

[51] Int. Cl.[6] ..... H05B 37/02

[52] U.S. Cl. ..... 315/102; 315/105; 315/307

[58] Field of Search ..... 315/102, 105, 315/106, 107, 94, 194, 307, DIG. 4, DIG. 5, DIG. 7

[56] References Cited

U.S. PATENT DOCUMENTS 3,720,861 3/1973 Kahanic ..... 315/107

5,175,471 12/1992 Stockinger et al. ..... 315/107

FOREIGN PATENT DOCUMENTS 0118309 9/1984 European Pat. Off. .

0471332 2/1992 European Pat. Off. .

3202445 8/1983 Germany .

3508431 9/1986 Germany .

*Primary Examiner*—Benny Lee

*Assistant Examiner*—Michael B. Shingleton

*Attorney, Agent, or Firm*—Sandler, Greenblum & Bernstein

[57] ABSTRACT

Method and apparatus for igniting fluorescent lamps at a predetermined temperature of their cathodes. In the present invention, it is the resistance of the cold lamp cathodes that is always measured and ignition occurs as a result of the relationships or conditions of the cold resistance to the hot resistance or the voltage relationship of cold to hot, so that the absolute value has no influence and correct preheating is achieved with all types of lamps.

11 Claims, 2 Drawing Sheets

METHOD AND CIRCUITRY FOR IGNITING FLUORESCENT LAMPS AT A PREDETERMINED TEMPERATURE OF THEIR CATHODES

BACKGROUND OF THE INVENTION

1. Field of the Invention

The invention relates to a method and a circuitry for preheating and igniting a fluorescent lamp having cathodes which can be heated where, after the supply voltage has been switched on, a circuit supplied by supply voltage first preheats the lamp cathodes in such a way that no sufficient voltage for the ignition of the fluorescent lamp occurs during the preheating phase, and where an ignition voltage is applied across the fluorescent lamp after a predetermined duration of the preheating phase. The invention also relates to a device for performing this method.

2. Description of the Prior Art

High quality auxiliary circuits for running fluorescent lamps do preheat the cathodes of the lamps before applying the ignition voltage to the fluorescent lamp. This considerably extends the useful life of the fluorescent lamps when compared with an ignition in the cold state. The documents EP-A-O 118 309 and DE-OS-32 02 445 disclose circuits which provide fixed duration of the preheating of the lamp cathodes. When the duration of the preheating of the lamp cathodes is thus fixedly determined, and considering the essentially constant preheating current, different types of fluorescent lamps having different resistance values of their cathodes are being heated differently. Because the optimal temperature of the cathodes when firing a limp lies between 600° and 700° C., it is practically impossible to determine a single fixed value of the preheating time which would be optimal for all types of fluorescent lamps. As a consequence of the fixed preheating time and the essentially constant preheating current, it follows that one and the same ballast circuit will insufficiently heat fluorescent lamps which have cathodes with low resistance, and overheat fluorescent lamps which have cathodes with a high resistance, which results in a shortened useful life of the fluorescent lamps and in higher running costs.

SUMMARY OF THE INVENTION

Hence, it is a general object of the present invention to provide a method for preheating and igniting fluorescent lamps, and also to teach a circuitry which allows to implement the method, in order to obtain an optimal duration of the preheating time, independently of the varying values of the resistance of the lamp cathodes.

According to the invention the desired result is obtained by measuring the resistance or the voltage of at least one lamp cathode during the preheating phase, determining the duration of the preheating phase as a function of this measurement, by measuring and storing the resistance of the voltage of the cold lamp cathode immediately after switching on the supply voltage, by thereafter measuring the momentary values of the resistance or the voltage of the lamp cathode whilst it is warming up, by comparing this stored value with the momentary value of the resistance or the voltage of the warm lamp cathode, and by applying the ignition voltage to the fluorescent lamp once a certain ratio of the momentary to the stored value of the current or the voltage of the lamp cathode has been reached. The device for performing the method according to the invention is characterized by a measuring circuit for measuring the voltage of the lamp cathode, by a sample and hold circuit which holds the voltage of the cold cathode, and by a circuit which compares the momentary voltage with the voltage of the cold lamp cathode.

BRIEF DESCRIPTION OF THE DRAWINGS

The invention will now be further explained through the description of embodiments of the same, and with the help of the appended drawing, in which.

DETAILED DESCRIPTION OF THE PREFERRED EMBODIMENTS

Figure 1:
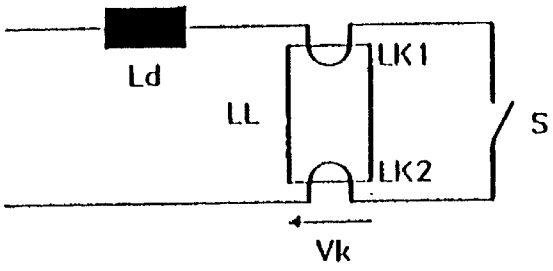
FIG. 1 schematically shows a fluorescent lamp operating with a ballast circuit which works with the frequency of the mains, FIG. 2 schematically shows a fluorescent lamp which operates with a ballast circuit working at a high frequency.

FIG. 1 schematically shows a circuit comprising a fluorescent lamp LL with its lamp cathodes LK1, LK2, a starter S and an inductor Ld. This known circuit corresponds to an inductive operating of the fluorescent lamp at the frequency of the mains (50–60 Hz). The switch S is an electronic starter, such as described for instance in the document EP-A-O 118 309. This switch is closed during the preheating phase of the lamp cathodes, and is opened after a time interval which is fixedly predetermined. When the switch is opened, the current through the inductor Ld is interrupted, and the fluorescent lamp LL is ignited through the voltage which is induced by the inductance Ld. Because the inductance of the inductor Ld is determined by the voltage and the current of the lamp during its functioning, the duration of the preheating by a preheating current which is thus predetermined must be chosen in a way which ensures that even the fluorescent lamps having cathodes with the very lowest resistance can be ignited. As a result, the fluorescent lamps having lamp cathodes with a high ohmic resistance will run for too long a time with this preheating current, which unnecessarily overheats such fluorescent lamps and shortens their useful life.

Figure 2:
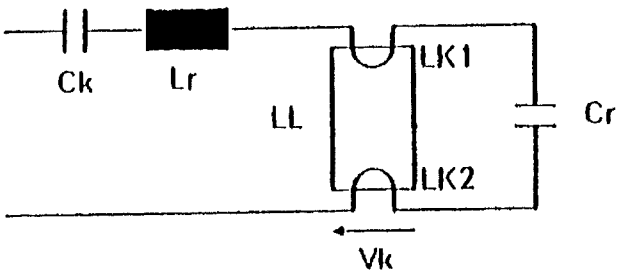

FIG. 2 schematically shows a fluorescent lamp LL with a serial resonant circuit comprising a coupling condenser Ck, a resonant inductor Lr and a resonant condenser Cr. This serial resonant circuit is used for electronic ballast circuits when the fluorescent lamp is run at a higher frequency (20–90 kHz). During the preheating the resonant frequency of the resonant circuit is modified in such a way that the voltage across the resonant condenser, and accordingly the voltage across the fluorescent lamp, does not ignite the fluorescent lamp; thus, a current which is essentially constant flows through the lamp cathodes LK1 and LK2, thereby preheating these. After the completion of the fixedly predetermined duration of the preheating, the frequency is modified so as to become similar to the resonance frequency of the resonant circuit, thus increasing the voltage across the resonant condenser Cr in a way which ensures the ignition of the fluorescent lamp. This method for preheating the lamp cathodes through a preheating time which has a predetermined length has exactly the same drawbacks for the useful lifes of the lamp as already mentioned in relation with the circuitry of FIG. 1.

Figure 3:
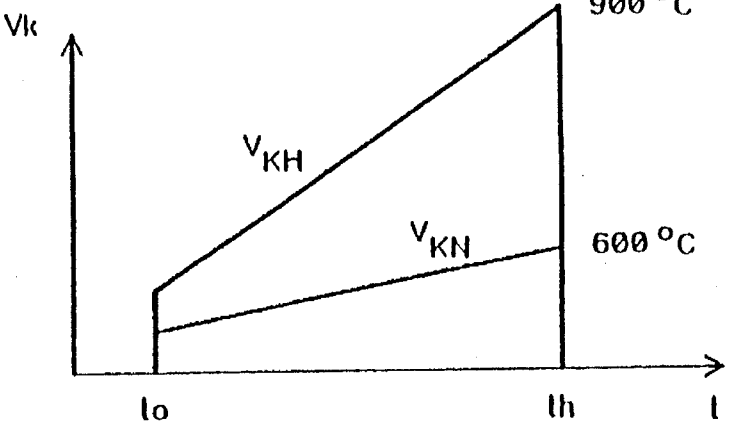
FIG. 3 shows a time diagram of the voltage of the lamp cathode during the preheating phase for known circuits.

FIG. 3 shows the time dependence of the voltage $V_k$ of the lamp cathode for a lamp cathode with a low ohmic resistance $V_{KN}$ and a lamp cathode with a high ohmic resistance $V_{KH}$, when both lamp cathodes are preheated with essentially the same preheating current and during the same length of time. The preheating current is switched on at a time $t_o$ and the voltage $V_k$ of the lamp cathode is directly proportional to the resistance of the cold lamp cathodes. The heating power $P_H$ applied to the lamp cathodes is the product of the square of the preheating current and the resistance of the lamp cathode. The final temperatures of the lamp cathode with a low resistance $V_{KN}$ and of the lamp cathode with a high resistance $V_{KH}$ at the time instant $t_h$ are entered in FIG. 3. One sees that given fixed preheating time $t_h$-$t_o$ the cathode with a high resistance and which will be heated with a greater power has much higher temperatures at the end of the preheating heating phase than the lamp cathode with the low resistance.

According to the invention, the temperature of the cathode of the lamp is ascertained before the ignition. The cathode of the lamp consists of a tungsten filament which has a temperature coefficient of 0.5%/K. If the voltage of the cold lamp cathode is known, one can thus directly determine the temperature of the lamp cathode from the measurement of the voltage $V_k$ of the lamp cathode.

Figure 4:
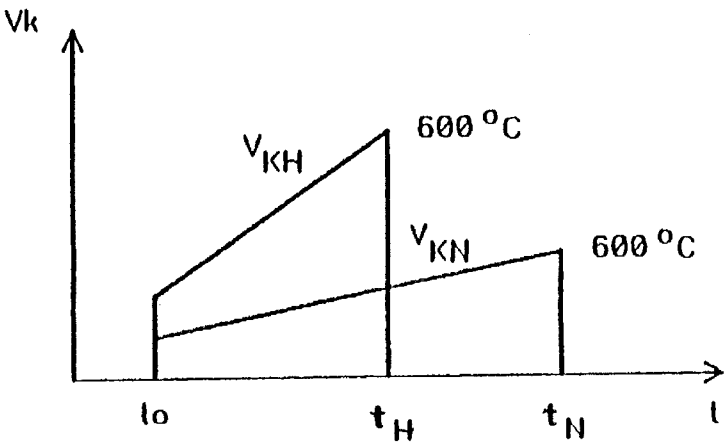
FIG. 4 shows the function of time of the voltages of lamp cathodes during the preheating phase according to the invention.

FIG. 4 shows the time dependence of the voltages of the lamp cathodes in an advantageous case according to the invention. In this case the duration of the preheating is determined in a way which ensures that the lamp cathode reaches a predetermined temperature. If this temperature is for instance 600° C., then the ratio of the resistance of the hot lamp cathode to the resistance of the cold lamp cathode is approximately equal to 3. Therefore, the lamp can be ignited when the measured resistance of the hot cathode is three times higher than the resistance of the cold cathode which was measured beforehand. Preferably, the ratio between the hot and cold cathode resistance is chosen such that the temperature of the cathode reaches 450° C. to 900° C. before ignition.

Figure 5:
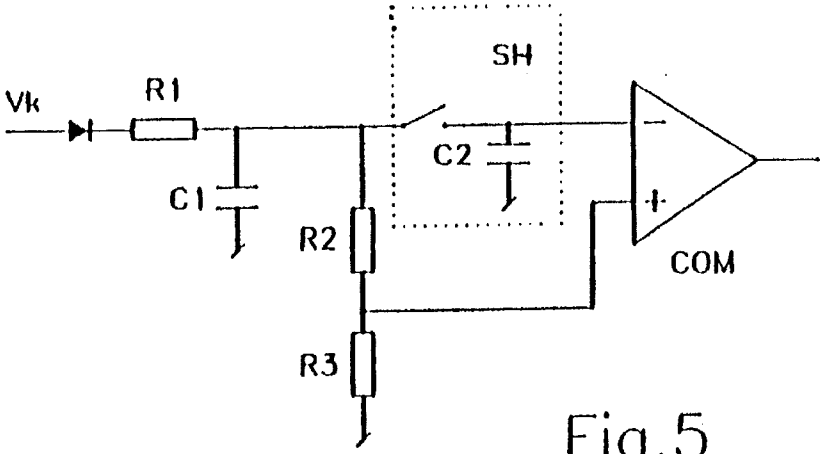
FIG. 5 shows an embodiment of the circuit for performing the method of the invention.

FIG. 5 shows an embodiment of a circuitry which allows to perform the method according to the invention. Here the voltage $V_k$ of the lamp cathode is rectified and its peak value is measured across a condenser C1. The peak value of the first half-wave, which corresponds to the voltage across the cold lamp cathode, respectively to the resistance of the cold cathode, is stored in a condenser C2, with the help of a sample and hold circuit SH. Because of the heating of the lamp cathode, the peak value of the momentary voltage of the lamp cathode steadily increases. With the help of a voltage divider R2/R3 and of a comparator COM, the time duration of the preheating phase is determined in such a way that the lamp cathodes always reach the same temperature. Actually, the output of the comparator is switched when the following condition is fulfilled:

$$V_{Khot}/V_{Kcold}=(R2+R3)/R3$$

The ratio 3:1 of the voltages or the cathode resistances, respectively, which corresponds to the temperature of about 600° C. chosen as an example, will thus be attained approximately when R2=2R3, or in other words when the voltage of the lamp cathode in the preheating phase has been multiplied by about 3.

Preferably, the duration of the preheating phase will in addition be limited to some maximal value (in the range of 1 to 5 seconds, for instance 2 seconds) if for some reason, such as too small a preheating current or cathodes which are already hot after a very short failing of the mains, it becomes impossible to reach the prechosen ratio $V_{Khot}/V_{Kcold}$. The maximal value can be set in a known manner by a timer, for example using an RC delay circuit.

Figure 6:
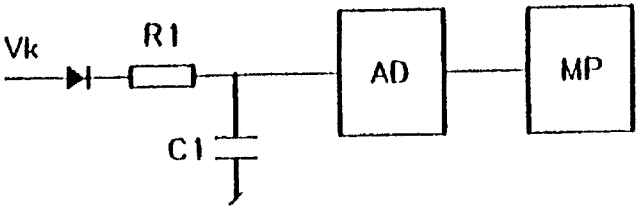
FIG. 6 shows a further embodiment of the circuit according to the invention.

FIG. 6 shows another circuitry which also allows to perform the method according to the invention. In this case the peak value of the voltage of the lamp cathode is measured with the help of an AD converter, and the measured values are transmitted to a microprocessor MP. Through a numeric comparison of the value which was first measured at the begin of the preheating period and the momentary value of the voltage of the lamp cathode it becomes possible to terminate the preheating phase when the predetermined ratio $V_{Khot}/V_{Kcold}$ is obtained, and to apply the ignition voltage to lamp cathodes which are then preheated precisely. The microprocessor will as well determine the maximal value of the preheating phase mentioned above, for example by starting an internal timer (counter) when the preheating phase begins.

The circuits of FIGS. 5 and 6 can be used both when the fluorescent lamp operates at the frequency of the mains and when it operates at higher frequencies.

Figure 7:
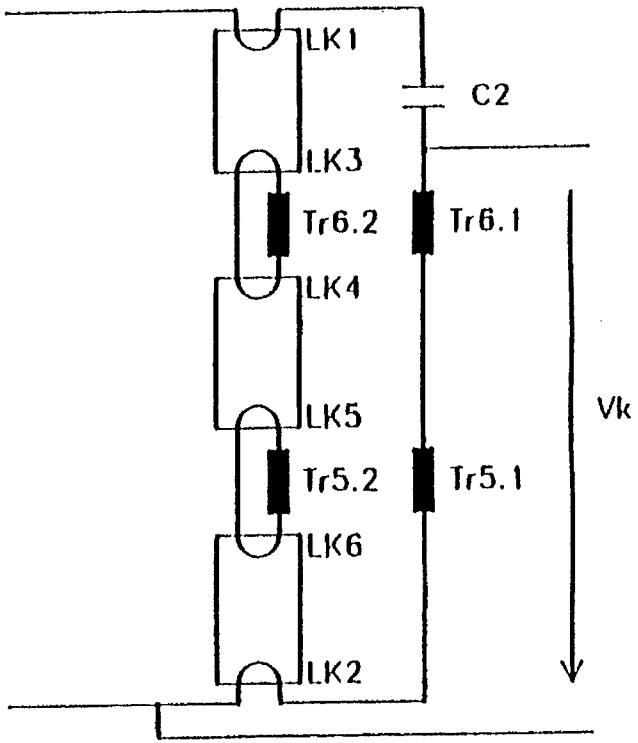
FIG. 7 shows another embodiment of the circuit according to the invention when using several fluorescent lamps.

FIG. 7 shows a further circuit which comprises several fluorescent lamps. When using several fluorescent lamps it can be advantageous to measure the average temperature of the cathodes of several lamps by observing the voltage of several cathodes which are connected in series.

The main aim of the method according to the invention is to obtain an optimal duration of the preheating time interval in view of the temperature of the lamp cathode. The indirect measurement of the temperature of the cathode of the lamps provides a method which permits an optimally effective use of the useful life of the fluorescent lamps, independently of their types. Only when the lamp cathodes are preheated with precision is a high number of switching procedures and a long life of the fluorescent lamps obtainable.

While there are shown and described present preferred embodiments of the invention, it is to be distinctly understood that the invention is not limited thereto, but may be otherwise variously embodied and practiced within the scope of the following claims.

I claim:

1. A method for preheating and igniting at least one fluorescent lamp including the steps of:

preheating the lamp cathodes such that insufficient voltage for ignition of said fluorescent lamp occurs thereacross during the preheating phase;

applying an ignition voltage across said fluorescent lamp at the end of said preheating phase; and wherein said preheating phase is determined by:

measuring and storing one of the resistance and the voltage of the cold lamp cathode immediately after switching on of the supply voltage;

thereafter measuring the momentary value of one of the resistance and the voltage of the lamp cathode when it is warming up;

comparing the stored value with the momentary value of one of the resistance and the voltage of the warm lamp cathode; and applying said ignition voltage to the fluorescent lamp once a predetermined ratio of said momentary to said stored value of one of the resistance and the voltage of said lamp cathode has been reached.

2. The method of claim 1 further including:

predetermining a maximal duration of the preheating phase; and starting the ignition independently of said measurements once said maximal duration has elapsed.

3. The method of claim 1 further including choosing the ratio of one of the resistance and the voltage of the warm lamp cathode to the stored value of one of the resistance and the voltage of the cold lamp cathodes such that the lamp cathode attains a temperature in the range of between 450° and 900° C. before the ignition voltage is applied.

4. The method of claim 2, wherein the maximum duration of the preheating phase of the fluorescent lamp is in the range of between 1 and 5 seconds.

5. The method of claim 1, further including the steps of:

rectifying the voltage of the lamp cathode;

storing the voltage measured on the cold cathode across a condenser;

comparing, with the help of a comparator, said cold cathode voltage with the momentary rectified voltage of the lamp cathode which has been lowered through a voltage divider, until the stored voltage of the cold cathode equals the lowered momentary voltage of the warm lamp cathode; and applying the ignition voltage to the fluorescent lamp once the output signal of the comparator has been switched.

6. The method of claim 1, including the steps of:

periodically measuring the voltage of the lamp cathode with an A/D converter;

storing the first measured value, which pertains to the cold cathode, in the memory of a microprocessor;

comparing the following measured values of the warm lamp cathode digitally with the stored value until a predetermined agreement of the numeric values is obtained; and thereafter applying the ignition voltage to the fluorescent lamp.

7. A device for preheating and igniting at least one fluorescent lamp with one of an electronic starter switch and a resonant circuit, respectively, for igniting the lamp after the preheating phase, the device comprising:

a measuring circuit for measuring one of the resistance and the voltage of a lamp cathode;

storage means connected to said measuring circuit;

a comparing circuit having inputs connected to said measuring circuit and to said storage means and having an output, with one of said electronic starter switch and said resonant circuit being controllable by said comparing circuit output for termination of the preheating phase and ignition of said fluorescent lamp.

8. The device of claim 7, wherein said measuring circuit is connected in parallel with the lamp cathode and comprises a serial arrangement of a diode, a resistor, and a condenser for capturing the peak value of the voltage of the lamp cathode.

9. The device of claim 7, wherein said storage means is a sample and hold circuit.

10. The device of claim 7, wherein said measuring circuit is an A/D converter which periodically measures the voltage of the lamp cathode and said storage means and said comparing circuit is a microprocessor which processes the signals of the A/D converter.

11. The device of claim 7, for operating a serial arrangement consisting of at least two fluorescent lamps, said device comprising at least one separating transformer wherein neighboring lamp cathodes of the fluorescent lamps are connected in series, and each such serial arrangement is connected in parallel to a second winding of said at least one separating transformer, with said measuring circuit being connected to one of a first winding of said at least one separating transformer and to several such first windings connected in series, respectively.

* * * * *